US007264525B2

(12) United States Patent
Tsitas

(10) Patent No.: US 7,264,525 B2
(45) Date of Patent: Sep. 4, 2007

(54) FLOTATION DEVICE

(75) Inventor: Steven Tsitas, Collingwood (AU)

(73) Assignee: Cetus Design Pty. Ltd. (AU)

( * ) Notice: Subject to any disclaimer, the term of this patent is extended or adjusted under 35 U.S.C. 154(b) by 276 days.

(21) Appl. No.: 10/504,635

(22) PCT Filed: Feb. 14, 2003

(86) PCT No.: PCT/AU03/00212

§ 371 (c)(1),
(2), (4) Date: Feb. 17, 2005

(87) PCT Pub. No.: WO03/068591

PCT Pub. Date: Aug. 21, 2003

(65) Prior Publication Data

US 2005/0142962 A1 Jun. 30, 2005

(30) Foreign Application Priority Data

Feb. 15, 2002 (AU) ..... PS0582

(51) Int. Cl.
*B63C 9/15* (2006.01)

(52) U.S. Cl. ..... 441/98; 441/90

(58) Field of Classification Search ..... None
See application file for complete search history.

(56) References Cited

U.S. PATENT DOCUMENTS 655,373 A * 8/1900 Roden ..... 441/98
2,309,256 A * 1/1943 Rekersdres ..... 441/98
3,084,357 A * 4/1963 Gaumer ..... 441/98
3,930,667 A 1/1976 Osuchowski et al.
RE28,916 E 7/1976 Rice et al.
4,060,866 A 12/1977 Robinson
4,066,415 A 1/1978 Kasama et al.
4,121,312 A 10/1978 Penney
4,527,582 A 7/1985 Buckle et al.
4,619,066 A 10/1986 Kirkland et al.
4,629,436 A 12/1986 Stewart et al.
4,676,760 A 6/1987 Massbaum (Continued)

FOREIGN PATENT DOCUMENTS

CN 2242438 12/1996

(Continued)

OTHER PUBLICATIONS

"Inflatable Marine Safety Equipment", FUSE Demonstrator Document, Dec. 26, 2000, Polymarien Ltd.

(Continued)

*Primary Examiner*—Lars A. Olson
(74) *Attorney, Agent, or Firm*—Stites & Harbison PLLC; Marvin Petry

(57) ABSTRACT

A flotation device (10) adapted to be worn by a person, said device (10) including at least one inflatable member (23) adapted to be inflated by gas generated by solid to gas generation means (21) and having means (30) to effect such inflation. The flotation device (10) also having a body (25) substantially encompassing at least one inflatable member (23) and the gas generation means (21) as well as release means for substantially releasing any inflatable members from the flotation device (10) while retaining the inflatable members (23) in connection with the flotation device (10).

14 Claims, 2 Drawing Sheets

U.S. PATENT DOCUMENTS

| | | | | |
|---|---|---|---|---|
| 5,030,152 | A | | 7/1991 | Carr et al. |
| 5,078,422 | A | * | 1/1992 | Hamilton et al. ..... 280/736 |
| 5,266,069 | A | | 11/1993 | Thorne |
| 5,311,394 | A | | 5/1994 | Naab et al. |
| 5,338,275 | A | | 8/1994 | Chek |
| 5,361,169 | A | | 11/1994 | Deal |
| 5,368,512 | A | | 11/1994 | Brown |
| 5,374,212 | A | | 12/1994 | Lall |
| 5,391,133 | A | | 2/1995 | Ruffa |
| 5,622,422 | A | | 4/1997 | Rodgers |
| 5,643,155 | A | | 7/1997 | Kallassy |
| 5,694,261 | A | | 12/1997 | Deal |
| 5,700,173 | A | | 12/1997 | Lerro |
| 5,820,530 | A | | 10/1998 | Kallassy |
| 5,823,840 | A | | 10/1998 | Powers |
| 5,947,788 | A | | 9/1999 | Derrah |
| 5,984,840 | A | | 11/1999 | Awbrey et al. |
| 6,109,203 | A | | 8/2000 | Mears |
| 6,158,380 | A | | 12/2000 | Aschauer et al. |
| 6,209,253 | B1 | | 4/2001 | Saldana, Jr. |
| 6,220,910 | B1 | | 4/2001 | Richey |
| 6,230,333 | B1 | | 5/2001 | Umeda |
| 6,328,618 | B1 | | 12/2001 | Fleischli |
| 6,342,031 | B1 | | 1/2002 | Vaughan |
| 6,379,205 | B1 | | 4/2002 | Wallasch |
| 6,379,206 | B1 | | 4/2002 | Wallasch |
| 6,394,867 | B1 | | 5/2002 | Bianco |
| 6,398,603 | B1 | | 6/2002 | Brown |
| 6,409,561 | B1 | | 6/2002 | Ibasfalean |
| 6,435,552 | B1 | * | 8/2002 | Lundstrom et al. ..... 280/741 |
| 6,436,014 | B1 | | 8/2002 | Cirjak |
| 2001/0002633 | A1 | | 6/2001 | Bockhold |

FOREIGN PATENT DOCUMENTS

| | | |
|---|---|---|
| GB | 2 343 151 | 5/2000 |
| GB | 2 345 031 | 6/2000 |

OTHER PUBLICATIONS

Fallis, et al, "Advanced Propellant/Additive Development for Fire Suppressing Gas Generators", from proceedings of Halon Options Technical Working Conference, 2000.

* cited by examiner

FLOTATION DEVICE

TECHNICAL AREA

This invention relates to the area of safety devices and in particular to personal flotation devices which can be inflated on an as needed basis but are otherwise not cumbersome for the wearer.

BACKGROUND TO THE INVENTION

Personal flotation devices are well known and for many applications, such as boating, are legislatively required to be worn by a boat user or carried aboard for use when necessary.

The types of flotation devices available include life jackets and vests as well as a wide range of inflatable clothing and potentially include items such as life rafts. Many approved life jackets are manufactured from buoyant foam type materials and are cumbersome to wear making many people reluctant to wear them.

An alternative flotation device is an inflatable life jacket however people such as those who fish from rocks or swimmers or surfers, who may well run the risk of drowning are unlikely to wear such devices. In particular, swimmers do not want the obstruction and drag of wearing such a device.

A difficulty which is associated with inflatable buoyancy devices is that a relatively bulky gas cylinder and valve mechanism is required to provide a given volume of gas, the gas customarily being Carbon Dioxide which is stored as a high pressure liquid in the cylinder. In addition many people who are not legislatively required to wear such garments for their particular water sport would not do so owing to the appearance of such garments.

It is known for children to wear inflatable devices on their bodies when learning to swim under supervision however these are usually not of a kind that could be deployed by an adult in an emergency.

OUTLINE OF THE INVENTION

It is an object of the invention to provide flotation devices which can be quickly inflated from a relatively compact gas source as required.

It is a further object of this invention to provide flotation devices which can be unobtrusively worn by a person, such as a swimmer, which do not impede normal activity but are capable of being deployed when required.

The invention is a flotation device adapted to be worn by a person, said device including at least one inflatable member adapted to be inflated by gas generated by solid to gas generation means and having means to effect such inflation.

The invention in another aspect is a flotation device which is adapted to be worn by a person, said flotation device having a body substantially encompassing at least one inflatable member and the gas generation means as well as release means for substantially releasing any inflatable members from the flotation device while retaining the inflatable members in connection with the flotation device.

It is preferred that the gas generation means is gas production by ignition of a solid propellant material activated by triggering means. It is further preferred that the ignition of the propellant material is effected by a discharge from a battery inside the flotation device when the triggering means is used.

The flotation devices of the invention which are inflated by gas generation from a solid propellant can encompass a wide range of items including small devices and inflatable clothing. It is however preferred that a flotation device of the invention of the type which is worn by a person be worn about the wrist. It is further preferred that such a device be of a compact size similar to that of a wrist watch.

While it may be preferred that the inflation device be worn about a person's wrist, for ease of activation of the device in the event of an emergency, it could however be worn on any preferred part of the body.

In order that the invention may be more readily understood we shall describe by way of non limiting example a specific embodiment thereof with reference to the accompanying drawings.

BRIEF DESCRIPTION OF THE DRAWING FIGURES

DESCRIPTION OF A PREFERRED EMBODIMENT OF THE INVENTION

Figure 3:
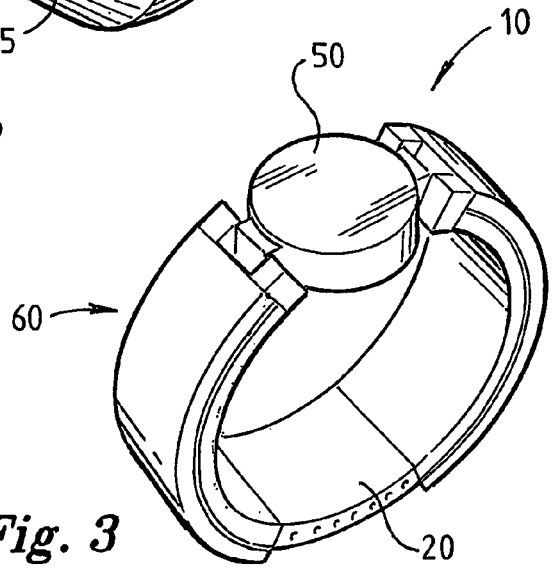
FIG. 3 shows a perspective view of the uninflated device of the invention.

In a first embodiment of the invention a marine security device 10 (FIG. 3) is provided which can be worn around a person's wrist in the same manner as a watch and is of a similar size and weight. It is also envisaged that, if desired, the security device could be associated with a wrist watch and/or an EPIRB (Emergency Position Indicating Radio Beacon).

While such a security device could be worn on any part of a body, such as around the waist or on a user's clothing, it is preferred that it be worn on a wrist for ease of access to it.

This embodiment of the invention includes means 20 for attaching the body of the security device to the wearer's wrist, and is similar in this embodiment of the invention to a watchband clip, although the precise means of doing this is not germane to the invention.

Figure 1:
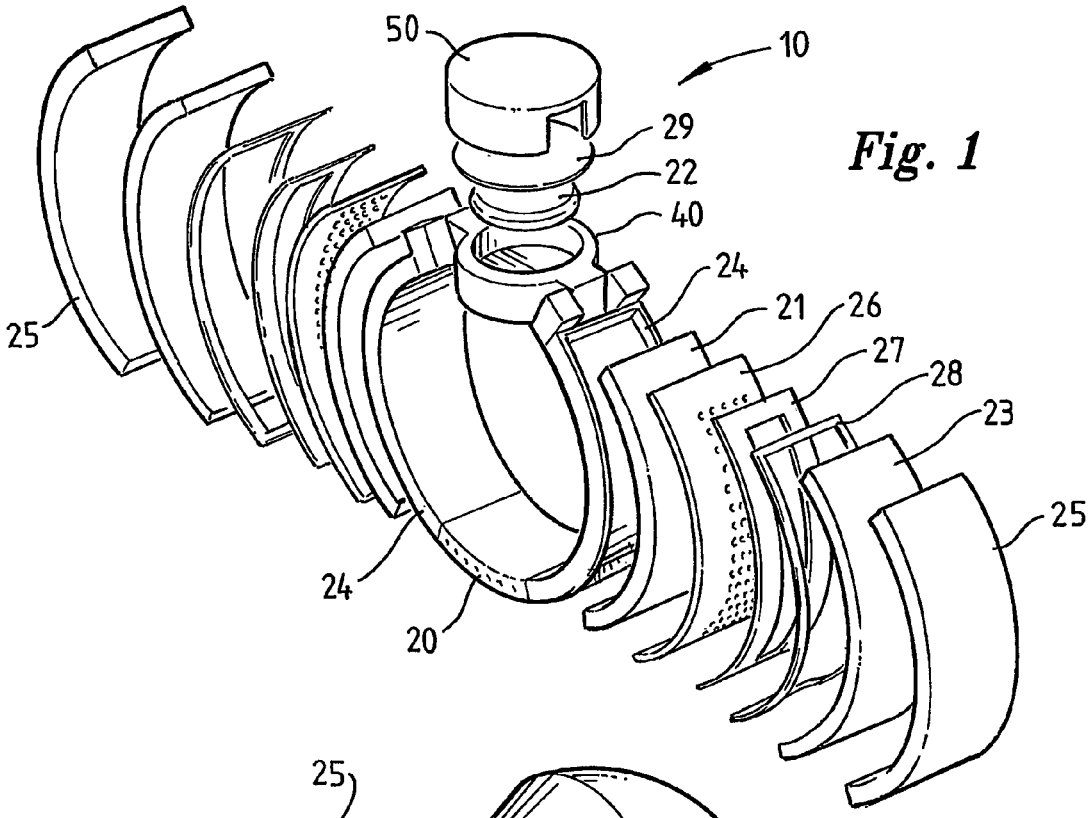
FIG. 1 is a schematic exploded diagram of a wrist worn embodiment of the invention.

FIG. 1 shows an exploded diagram detailing the components of this embodiment of the invention. The interior of the body of the device includes a gas source which is a gas generant 21 which is ignited by the current generated from a battery source 22 which activates an ignition device 30 (FIG. 6) which is embedded in the gas generant 21.

The ignition device is preferably a modified mini lamp member which is connected to a twin pair of wires 36 leading to the gas generant 21 from battery 22. the lamp is modified by grinding a hole in the glass surrounding the filament, pouring in a small quantity of black powder and sealing the hole with tape to retain the powder.

When inflation is activated the electrical current causes the filament, now exposed to atmospheric oxygen, to disintegrate such that hot remnants landing on the black powder creates a small amount of hot gas which exhausts through the hole in the glass and ignites the gas generant. This compact igniter functions reliably even with the small current from a compact battery or a number of compact batteries.

The arrangement is such that gas is emitted rapidly into an inflation device or bladder 23 which is substantially ejected from the body of the security device. It is preferred that the device be provided with gas generant and inflation bladders on either side of the device.

While a particular means of commencing gas production has been described here it is envisaged that any appropriate means could be used.

The device of the invention has a wrist band 60 which includes a frame 24 manufactured from a strong plastic to insulate the wearer's wrist from potential high temperatures resulting from the ignition of the gas generant.

In this embodiment of the invention the gas generant is immediately proximate the plastic frame 24 with a filter/heat exchanger 26 on its other side.

The filter is preferably composed of alumina fibres in paper form sandwiched between two metal strips perforated with small holes. This filter acts as a brace which strengthens the frame. In addition it acts to trap any solid residue resulting from the ignition of the gas generant and prevents such residue affecting the bladder or inflatable device 23 or the wearer in the event the bladder tears or detaches from the device.

Figure 2:
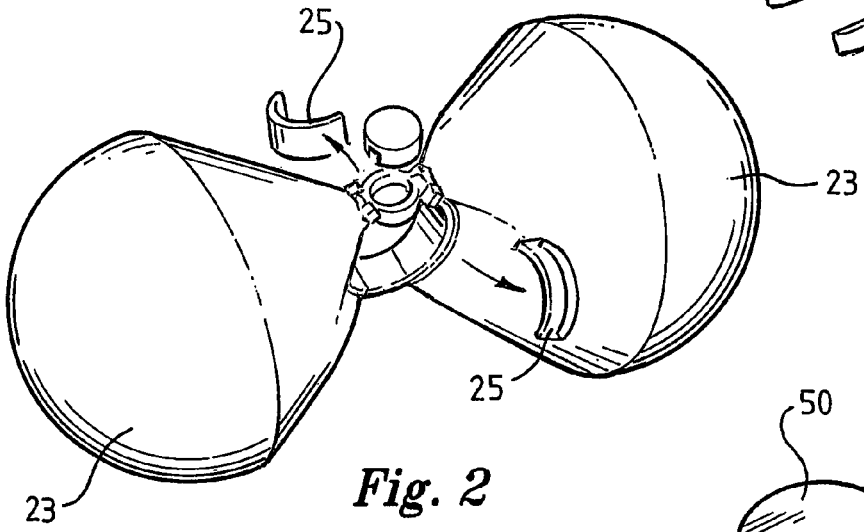
FIG. 2 is a schematic representation of the device of FIG. 1 in inflated form.
Figure 7:
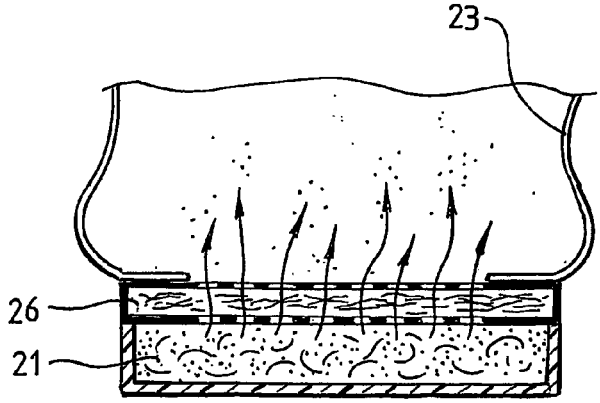
FIG. 7 shows a schematic view of the inflation process of the invention.

The apertures in the metal strips and porosity of the alumina fibre paper permit the gas to pass through into the bladder and inflate it while heat generated is dissipated throughout the filter. The process whereby this occurs is shown in FIG. 7 while the inflated device is shown in FIG. 2.

The arrangement is held in place as shown in FIG. 1 by airbag bladder glue 27 and glue 28 to retain the protective cover 25 on either side of the device prior to inflation. The resulting wrist band is joined to the central tub 40 by means of a rod through apertures 41 in an extension 42 to tub 40 and extension 43 to the wrist band.

Although any appropriate gas generant could be used it is preferred that a non azide gas generant be used, for example a solid propellant composed of 5-amino-tetrazole is preferred as the fuel with strontium nitrate as the oxidiser. It is not a requirement that the gas generation be particularly rapid and it is in fact preferred that the reaction time be of the order of 1 sec.

In this embodiment of the invention each airbag device has a 5 liter volume when inflated. As two such bags are used there is a resultant buoyancy of 10 kg. The bag material may be of a material such as Nylon, Polyester or Polyethylene or some combination of these. The material used however preferably has a density of 25 $gm/m^2$ such that the bag is strong and resistant to damage. Where the bag is manufactured of Polyethylene for example, having a bulk density of 0.9 gm/cc, the packed bag has a thickness of 3 mm while the band 60 has side components which are 24 mm wide and 65 mm long. Allowing for a protective cover 25 of 1 mm in depth the total thickness of the wrist band 60 is of the order of 10 mm in this embodiment of the invention.

The means for activating the gas inflation means is incorporated into a central "tub" 40 which also has a depth of 10 mm and the estimated overall weight of this embodiment of the invention is of the order of 100 gm which is less than that of many watches designed for marine use.

Figure 5:
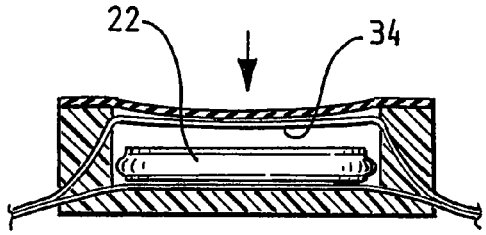
FIG. 5 shows the operation of the battery used in the invention.

The gas generation activation means is contained in central tub 40 having a battery 22 which actuates the gas generation when contacts 34 on a flexible activation button 29 is pressed against the battery as shown in FIG. 5. To prevent accidental or unwanted activation a protective cap 50 is provided to cover this mechanism.

Figure 4:
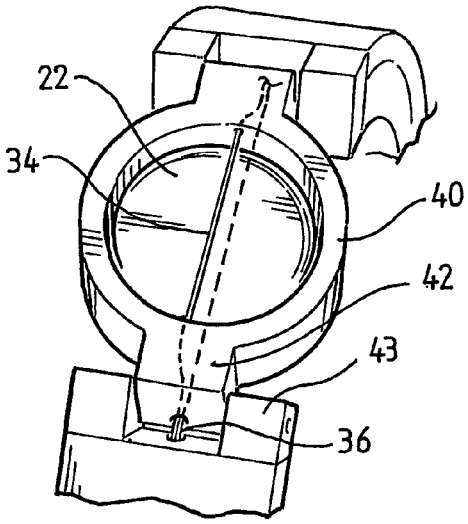
FIG. 4 shows a perspective view of the upper part of the device of the invention.
Figure 6:
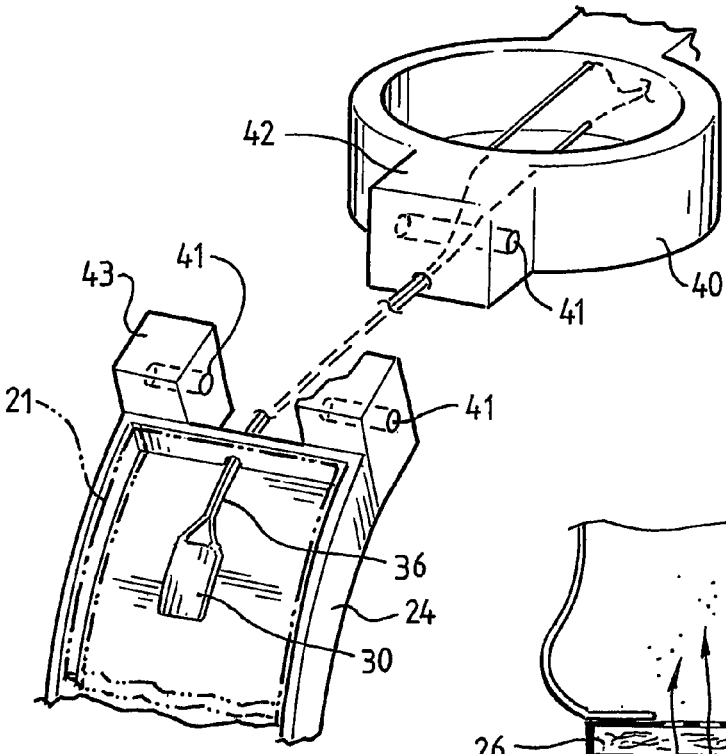
FIG. 6 is a schematic diagram of the electrical ignition system used for the inflation mechanism.

The activation procedure involves the removal of cap 50 and the simple depression of flexible button 29, with watertight seal, onto the terminal of the underlying battery 22. The arrangement as shown in FIGS. 5 and 6 is such that a current flows through twin wires 36, as shown in FIG. 4, to an ignition device 30 embedded in each portion of gas generant.

As previously described current through the terminal endings of the wires 36 to the ignition device creates a small amount of hot gas which ignites the generant and causes the inflatable devices 23 to become inflated as the outer covers of the device 25 are forcibly propelled away from the device.

In the embodiment of the device described the central tub acts solely as a housing for the switch mechanism. It is however envisaged that it could also incorporate a watch mechanism or any other matter which was desired.

The switch mechanism described has the further advantage that apart from its ability to be manually activated it is also a truly hydrostatic switch. This is because increased pressure under water can cause the flexible button to contact the battery.

It would also be possible to provide a compressed gas source such as a carbon dioxide cylinder such as is used for the inflation of conventional life vests. The solid to gas source is however preferred as, for the production of a given volume of gas, it is much less bulky than a compressed gas cylinder and valve mechanism which could produce a comparable gas volume. It also acts substantially more quickly.

It may be preferred that the bladder remains directly attached to the body of the flotation device or it may be preferred that it be either removable from the body or remain attached to it by means of some tethering device such as a cord. It is further envisaged that two such inflatable bladders may be provided so that the system is fail safe.

In addition the shape of the bladder may be any which is desired depending on the requirement of the user.

For example the inflated bladder, if remaining attached to the wrist, could be of any shape as long as it provided the support required. Alternatively it may be preferred that the bladder inflate to some shape such as a life ring which, if it was able to float at some small distance from the user and remain tethered to the security device body and hence be accessible to the user, could be used for that purpose.

Any bladder shape which would provide useful support to a person requiring it when in the water would be appropriate for the purpose of the invention.

The flotation device of the invention is preferably triggered using a switch mechanism, which in this embodiment of the invention is activated by a button over a recess in the body of the device which is preferably covered with a protective cover to protect it against accidental activation. The cover could be non watertight and the button could be designed to be depressed by increasing water pressure, allowing automatic activation at a predetermined depth.

Preferably such a cover would be manufactured from a non corrosive material such as stainless steel or the like and some or all of the cover surfaces could be highly polished to a mirror like surface thereby allowing the cover to be used as a signal mirror. Any appropriate materials however can be used to manufacture any of the components of the invention.

It is however preferred that materials be chosen which keep the size and weight of the security device of the invention to a minimum.

It is further envisaged that a signal light could also be incorporated into the flotation device which light is operated by means of the device battery and is activated either automatically or manually when inflation is initiated.

By wearing the flotation device of the invention a swimmer or fisherman or other person, such as boat user who fell into the water while not wearing a life jacket, would be able to activate the flotation device and hopefully remain buoyant until rescue arrived.

Clearly, while the invention is not intended as a substitute for conventional personal flotation devices, it would be a valuable aid to swimmers and the like who would not normally wear flotation devices as well as providing a useful adjunct to those who do wear such devices.

The invention therefore would be a valuable aid in helping prevent death by drowning in the group of people who would not expect to require a life jacket.

It is also envisaged that the invention could be used for applications other than marine applications where emergency flotation could be required such as in avalanche conditions or any entrapment of a person in a fluid material such as quicksand.

Whilst we have described herein specific embodiments of the invention it is envisaged that other embodiments of the invention will exhibit any number of and any combination of the features previously described and it is to be understood that variations and modifications in this can be made without departing from the spirit and scope of the invention.

The invention claimed is:

1. A flotation device adapted to be worn by a person, comprising:

a gas generator having a solid propellant material and operable to generate gas by ignition of said solid propellant material;

a battery device;

a trigger for controlling said battery device to activate said ignition of the solid propellant material; and at least one inflatable member adapted to be inflated by gas generated by said gas generator.

2. A flotation device as claimed in claim 1, further comprising a body substantially encompassing said at least one inflatable member and the gas generator, and a release for substantially releasing said at least one inflatable member from the flotation device while retaining inflatable members in connection with the flotation device.

3. A flotation device as claimed in claim 2, wherein the flotation device is adapted to be worn about a person's wrist.

4. A flotation device as claimed in claim 3, wherein the flotation device is compact and dimensioned similarly to a wristwatch.

5. A flotation device as claimed in claim 2, wherein the flotation device is suitable for deployment in avalanche conditions.

6. A flotation device as claimed in claim 1, wherein the trigger includes a removable protective cap covering a flexible button device in sealing engagement with a container holding the battery device, arranged such that contact between the button device and the battery device initiates inflation of the inflatable members.

7. A flotation device as claimed in claim 6, wherein there are two inflatable members each of which is generally spherical and located on either side of the trigger.

8. A flotation device as claimed in claim 6, wherein contact between the button device and battery device is effected by a hydrostatic mechanism.

9. A flotation device as claimed in claim 1, comprising two inflatable members.

10. A flotation device as claimed in claim 9, wherein each of said inflatable members is a lobe when inflated.

11. A flotation device as claimed in claim 10, wherein each of said inflatable members is an orb when inflated.

12. A flotation device as claimed in claim 10, wherein each of said inflatable members is generally spherical when inflated.

13. A flotation device as claimed in claim 9, wherein said inflatable members extend in generally opposed directions when inflated.

14. A flotation device as claimed in claim 1, wherein said trigger includes an activating switch and a cover for removably covering said switch, wherein said switch is accessible by removing said cover.

* * * * *